US006009785A

United States Patent [19]

Ott

[11] Patent Number: 6,009,785

[45] **Date of Patent: *Jan. 4, 2000**

[54] CUTTING MECHANISM FOR A TRAVELING WEB

[75] Inventor: Jürgen Ott, Dettenheim, Germany

[73] Assignee: Meto International GmbH, Hirschhorn, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/744,495

[22] Filed: Nov. 7, 1996

[51] Int. Cl.[7] ..... B65H 23/16

[52] U.S. Cl. ..... 83/447; 83/450

[58] Field of Search ..... 83/443, 446, 447, 83/449, 450, 145, 349, 438, 448

[56] References Cited

U.S. PATENT DOCUMENTS

| | | | |
|---|---|---|---|
| 1,132,129 | 3/1915 | Stevens | 83/447 |
| 1,357,644 | 11/1920 | Leonard . | |
| 2,379,682 | 7/1945 | Colucci et al. | 83/145 |
| 2,764,087 | 9/1956 | Stobb . | |
| 3,173,324 | 3/1965 | Pass | 83/488 |
| 3,387,519 | 6/1968 | Nebel | 83/449 X |
| 3,673,905 | 7/1972 | Kono | 83/443 X |
| 3,856,196 | 12/1974 | Bayne et al. . | |
| 4,085,878 | 4/1978 | Nausedas . | |
| 4,472,988 | 9/1984 | Coburn | 83/438 X |
| 4,693,151 | 9/1987 | Goubeaux et al. . | |
| 4,735,034 | 4/1988 | Taylor et al. . | |
| 4,949,606 | 8/1990 | Pfeiffer . | |
| 4,975,781 | 12/1990 | Hirose | 358/304 |
| 5,000,069 | 3/1991 | Knobel | 83/342 X |
| 5,058,474 | 10/1991 | Herrera | 83/447 |
| 5,121,663 | 6/1992 | Tahara et al. | 83/145 X |
| 5,165,314 | 11/1992 | Paulson et al. | 83/449 X |
| 5,203,246 | 4/1993 | Smitterberg et al. | 83/447 X |
| 5,301,579 | 4/1994 | Shiotani et al. | 83/98 |
| 5,431,077 | 7/1995 | Murakami | 83/508 X |

FOREIGN PATENT DOCUMENTS

| | | |
|---|---|---|
| 22 38 320 | 2/1974 | Germany . |
| 87 16 108 | 3/1988 | Germany . |
| 91 05 290 | 8/1991 | Germany . |
| 2 169 237 | 2/1988 | United Kingdom . |
| WO 92/07693 | 5/1992 | WIPO . |

*Primary Examiner*—Kenneth E. Peterson
*Attorney, Agent, or Firm*—Darby & Darby

[57] ABSTRACT

A cutting mechanism for a flat material web housing a printer unit, in particular for the production of labels or tags. The cutting mechanism includes an entrance section, a cutter section, and an exit section. A damping device formed by a damping plate or a piece of damping metal is provided to take up and damp any shock waves occurring in the flat material web as a result of the cutting action. To be able to define and adjust the position relative to a printer unit, an adjusting device is provided so that the housing of the cutting mechanism can be adjusted relative to the mounting section of the printer unit.

3 Claims, 2 Drawing Sheets

CUTTING MECHANISM FOR A TRAVELING WEB

FIELD OF THE INVENTION

The present invention relates to a cutting mechanism for a traveling web of flat material.

BACKGROUND OF THE INVENTION

U.S. Pat. No. 3,856,196 discloses a device for severing web-shaped material, in particular paper webs for producing cards. Prior to being fed to a cutting mechanism that cuts the web into individual sections, the web is passed between a brake roll and an angled plate or a trough in order to relieve the web of part of the tension produced by a feeding mechanism arranged in advance thereof, thus preventing the formation of burrs or other deformations on the web perforations that may interact with the feeding mechanism.

Another cutting device is known from U.S. Pat. No. 4,693,151. According to this patent a cutting mechanism serves to sever record members from a web for subsequent use as tags, for example. The cutting mechanism cuts the longitudinally traveling web transversely with coacting knives. The cutting mechanism is arranged in the interior of a housing having an entrance section in the form of an opening for introducing the web. The severed record members of the web are then fed to a stacker disposed in the housing interior.

Operating, for example, as label or tag cutters, cutting mechanisms of this type are arranged at the output end of a printer unit in which portions of the continuously fed web of flat material are printed upon. In the cutting mechanism, consecutive printed portions of the flat material web are severed essentially transversely to the direction in which the web travels.

The severing cut which extends transversely to the feeding direction is conventionally performed by a rotating cutter roll whose axis of rotation is normal to the feeding direction and parallel to the plane of the web. At least one blade member provided on the circumference of the cutter roll extends preferably in a slightly spiral fashion so that in operation of the cutting mechanism a cut is produced from one side of the web to the other side. Although the cutting speed is very high as compared with the speed at which the flat material web travels, the cutting action performed normal to the feeding direction interferes with or blocks the web feeding action. Experience has shown that this cutting action causes shock waves to propagate in opposition to the feeding direction in the flat material web. In addition, distortion occurs in the plane of the flat material web about the instantaneous position of the cutting location extending transversely to the web. This distortion results from the fact that when looking at a cutting operation—the subsequently advanced web encounters no resistance in the area following the cutting location of the blade member, that is, the area where the severing cut has already taken place, while the subsequently advanced web encounters a maximum resistance at the instantaneous position of the cutting location. At the section not yet severed in the cutting direction ahead of the instantaneous position of the cutting location, the subsequently advanced web meets a resistance which is of an order of magnitude lying between the resistance values of the two previously described sections.

The disturbances generally referred to as shock waves propagate in opposition to the feeding direction of the flat material web and may cause unseating of the print head of a printer unit arranged in advance thereof, resulting in poor printing quality. Where bar code printers are used, the bar code pattern may cease to be readable.

The brake roll disclosed in U.S. Pat. No. 3,856,196 is relatively complex and has only its surface line in contact with the flat material web so there is no areal carries contact with the web and there is insufficient damping of the shock waves.

Cutting mechanisms of the prior art are detachably connected with a printer unit by a fastening means. In these arrangements, it is not possible to accurately define the position of the cutter section relative to the print head of the printer unit, nor the variation of the relative distance of the cutter section to the print head of the printer unit.

SUMMARY OF THE INVENTION

It is an object of the present invention to improve upon a cutting mechanism of the type disclosed in the prior art so the undesired shock waves produced by the cutting action are taken up and damped, such that they have only a substantially diminished adverse effect on an apparatus arranged in advance of the entrance section.

It is a further object to avoid the shortcomings of prior known non-adjustable cutting mechanisms.

According to a first aspect of the present invention, these objects are accomplished by a cutting mechanism for a traveling flat material web, in particular for the production of labels or tags, wherein the cutting mechanism includes an entrance section, a cutter section, an exit section, as well as a damping device associated with the entrance section and arranged on the side close to the flat material web. This mechanism is characterized in that the damping device is formed by a damping plate or a piece of damping metal arranged to take up and damp any shock waves occurring in the flat material web as a result of the cutting action.

In the cutting mechanism of the present invention, rather than preventing the formation of shock waves, it is their disturbing propagation in opposition to the feeding direction which is prevented from occurring. By damping the shock waves, their energy is absorbed such that, depending on the damping intensity, they are no longer noticeable at a specified distance from the cutting mechanism, such as in the area of the print head of a printer unit, or at least they cease to have an adverse effect. The damping device is formed by a damping plate or a piece of damping metal arranged on the side close to the flat material web. When shock waves occur, the damping plate or the piece of damping metal makes areal contact with the web, thereby enabling the energy of the shock waves to be absorbed efficiently.

It has proven to be advantageous to provide the damping plate or the piece of damping metal with a bent configuration.

It would be possible to arrange the damping plate or the piece of damping metal so that it rests on the flat material web, thus preventing the shock waves from propagating. In contrast to this, it is proposed to arrange the damping plate or the piece of damping metal pivotally so as to enable it to be deflectable by shock waves occurring in the flat material web. In this arrangement, it is advantageous to bias the damping device, in particular the plate or the piece of metal, in the direction of the flat material web and to make the biasing force of the damping device adjustable. The adjustability may be accomplished, for example, by the provision of various positions or mounting locations of a leg of a spring, in particular a spiral spring.

In a preferred embodiment of the present invention, the damping device is configured and arranged so as to serve at the same time the function of a guiding means for the flat material web. To this end, the bent configuration of the damping plate, or the piece of damping metal previously referred to, proves to be advantageous. Preferably, the entrance section of the cutting mechanism has an insertion slot tapering in the feeding direction and bounded on at least one side by the damping plate or the piece of damping metal. On the side opposite the damping plate or the piece of damping metal, this insertion slot is bounded by a guide surface which is in a particular equally accurately curved configuration. Preferably, the two curves extend in the same direction.

Advantageously, the damping device may be configured such that the damping plate or the piece of damping metal rests on the guide surface. In this configuration, a surface area or edge of the plate or piece of metal extending transversely to the feeding direction may rest on the guide surface. In contrast to this, however, an embodiment is preferred in which the damping plate or the piece of damping metal rests on the guide surface through the intermediary of lateral spacers, thus also enabling a very thin web, such as thermal paper of a thickness of 0.18 mm, approximately, to be readily introduced into the entrance section of the cutting mechanism. Preferably, the clear opening of the insertion slot has its minimum extent in a direction transverse to the plane of the web, which extent is slightly greater than the thickness of the web. Even minor shock wave amplitudes are then effectively damped. Advantageously, the damping plate or the piece of damping metal has a minimum relative distance to the guide surface of 0.35 mm to 2 mm, preferably of 0.5 mm to 1 mm.

According to a second aspect of the present invention, provision is made for a cutting mechanism for a flat material web, in particular for producing labels or tags, which has a housing and a fastening device for coupling the housing to a printer unit. The fastening device includes a mounting section insertable into a mating receiving socket and fixedly securable therein, wherein the housing of the cutting mechanism is adjustable relative to the mounting section.

According to the present invention, first the mounting section of the fastening device is inserted into the receiving socket on the printer unit and located in position, which mounting section may be an anchor plate, for example. The housing which accommodates or carries the cutter unit is adjustable relative to the mounting section, thus enabling the relative distance of the housing, and thus of the cutter unit, to the mounting section to be adjusted.

In its simplest configuration, the fastening device could be L-shaped, with the housing being carried by an approximately horizontal leg of the L-shape and being slidable thereon. In one embodiment of the present invention, the mounting section has on its side close to the housing at least one locating means shaped in the manner of a rod, a bushing or a pin protruding in the direction of and extending through the housing. In this embodiment, the housing may be slidably held and/or guided by the protruding locating means.

In another configuration of the present invention, the free end of the protruding locating means extending through the housing cooperates with an adjusting device. The adjusting device includes a reference element connected with the free end of the protruding locating means, with the relative distance of the reference element to the housing, and thus the relative distance of the housing to the mounting section, being adjustable.

In a preferred embodiment, the reference element is a plate which is connected with the free ends of two protruding locating means and has an adjusting screw. Provision could be made for the adjusting screw to be screwed into a thread in the plate, taking support upon the housing. However, an embodiment is preferred in which the adjusting screw or a screw spindle is adjustably threaded into the housing and is displaceable relative to the reference element rotatably, yet not axially. Turning the adjusting screw or screw spindle then causes the housing to be moved towards or away from the reference element.

BRIEF DESCRIPTION OF THE DRAWINGS

Further features, details and advantages of the present invention will become apparent from the accompanying drawings and the subsequent description, wherein.

DESCRIPTION OF THE PREFERRED EMBODIMENT

Figure 1:
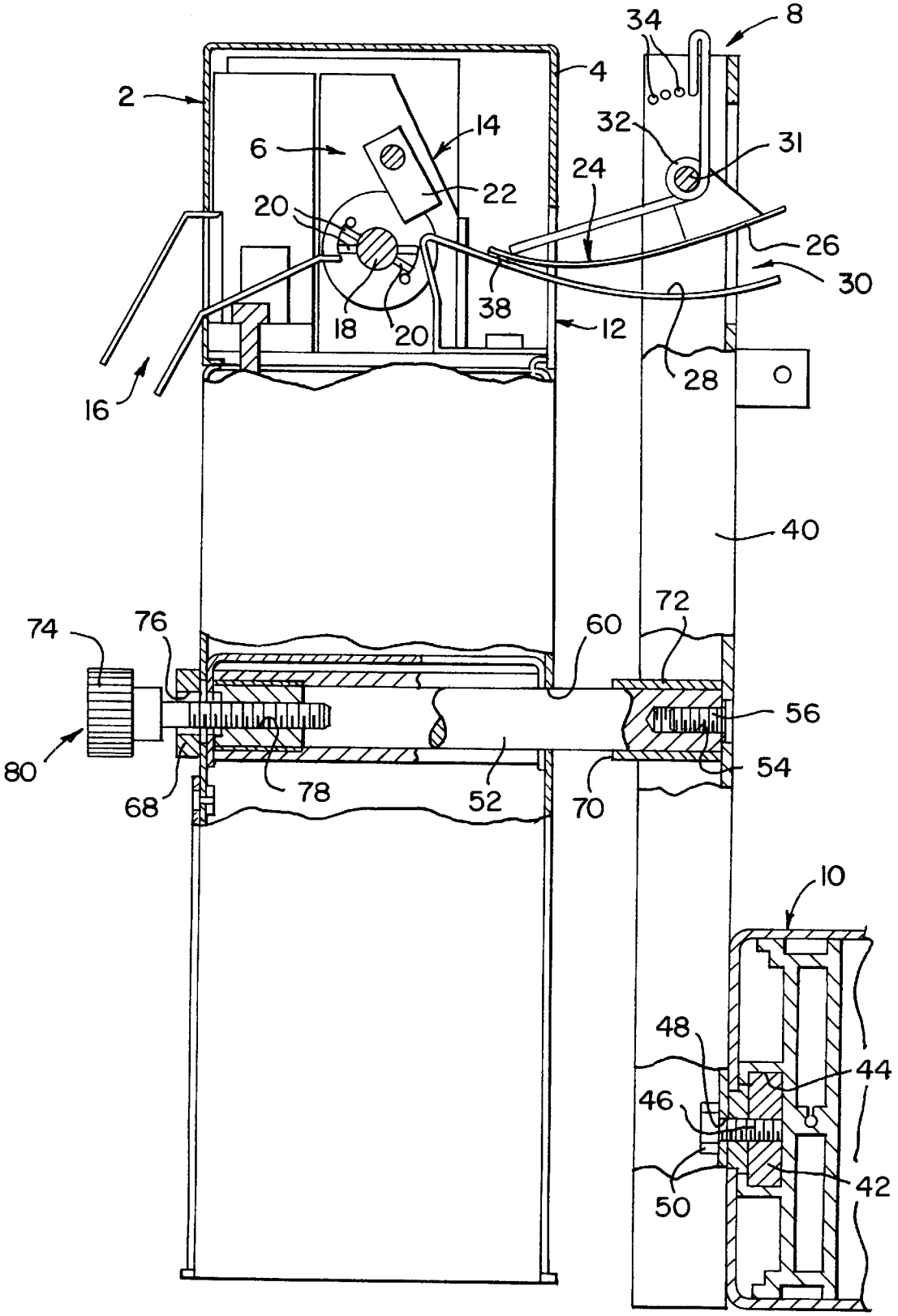
FIG. 1 is a partial sectional side view of a cutting mechanism constructed in accordance with the present invention.
Figure 2:
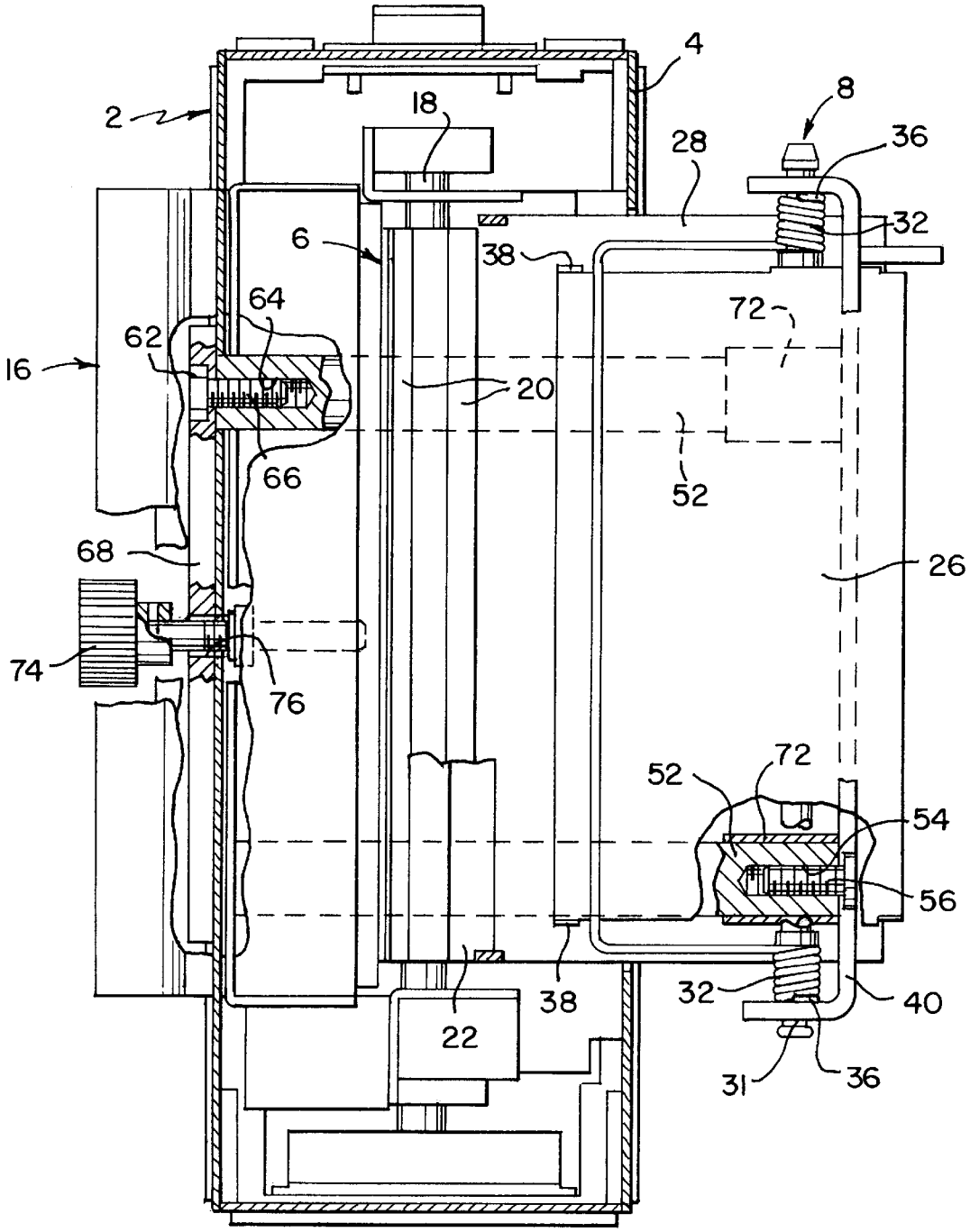
FIG. 2 is a partial sectional top plan view of the cutting mechanism of FIG. 1.

The cutting mechanism comprises a housing 2 on which a cutter unit 6 coverable by a hinged lid 4 is seated. The housing 2 accommodates the electronic equipment and the drive mechanism for the cutter unit 6. The cutting mechanism with its housing 2 is attached to a printer unit 10 illustrated only in part by means of a fastening device 8.

The cutting mechanism comprises an entrance section 12 for a flat material web to be severed into consecutive portions, a cutter section 14 and an exit section 16 for portions of the web severed transversely to the feeding direction. The cutter unit 6 comprises a cutter roll 18 which is rotatable transversely to the feeding direction of the flat material web to be cut and carries blade members 20 extending equally transversely to the feeding direction. In cutting, the cutter roll 18 is driven under solenoid control, such that the blade members rotate past a stationary biased cutter beam 22 serving as an abutment for the blade members 20. Because the blade members 20 extend in a slightly spiral configuration as becomes apparent from FIG. 1, the cutting location, that is, the point of contact between the blade member 20 and the cutter beam 22, travels transversely to the feeding direction from one longitudinal edge of the flat material web to the other.

While cutting, shock waves are generated which propagate in opposition to the feeding direction, (i.e., in the direction toward the print head, not shown, of the printer unit 10) and causes disturbances. To counteract these shock waves, a damping device generally designated by reference numeral 24 is provided. The damping device 24 comprises a bent piece of damping metal 26 associated with a guide surface 28 of the entrance section 12. This damping plate 26 and the guide surface 28 define an insertion slot 30 for the flat material web to be cut into individual portions, said slot tapering in the feeding direction. The damping plate 26 is hinged to the fastening device 8 so as to be pivotal about an axle 31 extending transversely to the feeding direction, and it is biased towards the guide surface 28 by a spiral spring 32. Various mounting locations 34 are provided for the leg 36 of the spiral spring 32 on the side remote from the damping plate 26, said mounting locations enabling the biasing force of the damping device 24 to be appropriately adjusted. Bearing against the guide surface 28, the damping plate 26, rather than resting with an edge extending transversely to the feeding direction on the guide surface 28, contacts the guide surface 28 by means of lateral spacers 38 which results in a slot-shaped space through which also thin webs such as thermal paper with a thickness of 0.18 mm, approximately, can be inserted in the direction of the cutter unit 6.

In the event of shock waves occurring during operation of the cutting mechanism, the yieldingly biased damping plate 26 is deflected, as a result of which an amount of energy is withdrawn from the shock waves and stored in spring 32. By suitably selecting the bias caused by spring 32 the withdrawn energy is sufficient to eliminate the adverse effect of the shock wave, in the area of the print head of the printer unit 10.

In the following, the adjustable fastening of the housing 2 of the cutting mechanism to the printer unit 10 will be described. The fastening device 8 comprises a mounting section generally designated by reference numeral 40 which has on its side remote from the housing 2 an anchor plate 42 slidable into a mating receiving socket 44 of the printer unit 10. The anchor plate 42 includes two threaded bolts 46 passing through an opening 48 of the mounting section 40 in the direction of the housing 2 and having a nut 50 screwed onto their free ends. By tightening the nut 50, the mounting section 40 can be fixedly located on the printer unit 10; the housing 2 with its cutter unit 6 is mounted only thereafter.

The mounting section 40 further includes two parallel bolts 52 projecting in the direction of the housing 2 and secured to the mounting section 40 with screws 56 that pass through tapped holes 54 provided at the front of the mounting section. The bolts 52 serve to hold and guide the housing 2. For this purpose, passage openings 60 are provided in the housing 2 through which the bolts 52 extend when the housing 2 is slid onto them. The free ends 62 of the bolts 52 passing through the housing are connection with a plate-shaped reference element 68 by screws 66 that pass through tapped holes 64 provided at the housing front. The housing 2 is slidably carried on the bolts 52, respective limits being defined by the reference element 68 on the one side and a bushing 72 on the other side, said bushing providing an axial stop 70 and being slipped onto bolt 52 and arranged between the housing 2 and the mounting section 40. To adjust the position of the housing 2 relative to the mounting section 40, an adjusting screw 74 is provided which extends from outside through a non-threaded passage opening 76 in the reference element 68 and is in threaded engagement with an internal thread section 78 within the housing 2. The adjusting screw 74 is rotatable relative to the non-threaded passage opening 76 in the reference element 68, and it is coupled to the reference element in an axial direction by means of an annular disk and a toothed spring lock washer such that the actions of screwing the adjusting screw 74 down into, or out of, the internal thread section 78 causes the housing 2 to be moved in the direction of the reference element 68 or away therefrom in the direction of the stop 70 of the bushing 72. In this manner, a fine adjustment of the relative distance of the cutter section 14 to the print head of the printer unit 10 can be accomplished. In this arrangement, the housing 2 is guided on the bolts 52 in a substantially clearance-free fashion and adjustable by the adjusting device 80 comprised of reference element 68, adjusting screw 74, and internal thread section 78.

While the present invention has been shown and described with reference to preferred embodiments thereof, it will be recognized by those skilled in the art that various changes and additions may be made without departing from the spirit and scope of the invention which is only limited by the appended claims.

What is claimed is:

1. A cutting mechanism for cutting a flat material web into individual portions as the web travels in a feeding direction from a printing head of a printer, said cutting mechanism comprising:

a housing including an entrance section for receiving the traveling flat material web;

a cutter disposed relative to said entrance section for transversely severing portions of the traveling flat material web relative to the feeding direction;

an exit section in said housing through which severed portions of the web are dispensed from the cutter; and means for damping web deflections from shock waves caused by transversely severing portions of the web, said means for damping being constructed and disposed relative to said entrance section to permit free and unimpeded web travel into said entrance section in the feeding direction without imposing a force on said web when said web is in an undeflected condition, wherein said means for damping includes a damping plate having one hinged end such that said damping plate is adapted for pivotal movement in response to deflections caused by shock waves occurring in the flat material, said damping plate being biased into an initial position relative to the flat material web without imposing a force on the web when said web is in an undeflected condition, said damping plate pivoting relative to said hinged connection when said web deflects against said damping plate from the shock waves caused by transversely severing said web.

2. A cutting mechanism as in claim 1, wherein the biasing force of said damping plate is adjustable.

3. A cutting mechanism as in claim 2, wherein:

said damping plate is biased by a spring having at least one leg; and the biasing force of said damping plate is adjusted by varying the position of said leg of said spring.

* * * * *